US011533982B2

(12) United States Patent
Wang

(10) Patent No.: US 11,533,982 B2
(45) Date of Patent: Dec. 27, 2022

(54) MULTI-PURPOSE BACKPACK

(71) Applicant: Zhenkun Wang, Marblehead, MA (US)

(72) Inventor: Zhenkun Wang, Marblehead, MA (US)

( * ) Notice: Subject to any disclaimer, the term of this patent is extended or adjusted under 35 U.S.C. 154(b) by 0 days.

(21) Appl. No.: 17/379,124

(22) Filed: Jul. 19, 2021

(65) Prior Publication Data

US 2022/0338610 A1 Oct. 27, 2022

(30) Foreign Application Priority Data

Apr. 26, 2021 (CN) ..... 202120880672.1

(51) Int. Cl.
*A45F 4/02* (2006.01)
*A47C 13/00* (2006.01)

(52) U.S. Cl.
CPC ..... *A45F 4/02* (2013.01); *A47C 13/00* (2013.01); *A45F 2004/026* (2013.01)

(58) Field of Classification Search
CPC ..... A45F 4/02; A45F 2004/026; A47C 13/00
See application file for complete search history.

(56) References Cited

U.S. PATENT DOCUMENTS 3,180,545 A * 4/1965 Southwick ..... A45F 3/08 224/263
3,759,482 A * 9/1973 Wright ..... A47B 97/08 248/449
3,909,061 A * 9/1975 Johnson ..... A47D 1/023 297/17
3,912,138 A * 10/1975 Pava ..... A45F 4/04 24/453
4,057,215 A * 11/1977 Stettler ..... A47B 97/08 248/460
4,123,127 A * 10/1978 Ford ..... A47B 97/08 312/231
4,489,866 A * 12/1984 Korte ..... A45F 4/02 224/636
4,836,938 A * 6/1989 Kobasic ..... A01M 31/02 224/155
5,332,283 A * 7/1994 Gray ..... A47C 4/52 297/16.2
5,409,291 A * 4/1995 Lamb ..... A01K 97/22 224/652
5,494,333 A * 2/1996 Wilson ..... A47C 15/004 248/188.5
5,499,760 A * 3/1996 Pielocik ..... A47C 13/00 224/155

(Continued)

*Primary Examiner* — Brian D Nash
(74) *Attorney, Agent, or Firm* — WPAT, PC

(57) ABSTRACT

A multi-purpose backpack that can help a user to rest has an appearance showing no difference with an ordinary backpack. A handle can be pulled to retrieve a retractable supporting structure up away from the backpack. The supporting structure can be fully expanded to form a stable triangular supporting device. A back sheet of the backpack can be turned pivotally to a front of the backpack for forming a soft seat. The soft seat can be connected with the supporting structure so as to form a seat without any foreign support. A neck bracket can be hanged and secured to the supporting structure. Thereupon, the multi-purpose backpack that helps the user to rest is fully expanded and set. By providing the multi-purpose backpack, people can rest anywhere and anytime at no need of any additional device.

8 Claims, 5 Drawing Sheets

(56) References Cited

U.S. PATENT DOCUMENTS

| | | | | | |
|---|---|---|---|---|---|
| 5,522,642 | A * | 6/1996 | Herzog | A47C 9/10 | 248/188.5 |
| 5,819,999 | A * | 10/1998 | Tennant | A47C 4/52 | 224/155 |
| 5,954,391 | A * | 9/1999 | Gray | A47C 4/18 | 297/58 |
| 6,135,557 | A * | 10/2000 | Gustafsson | A47C 4/286 | 297/16.2 |
| 6,145,716 | A * | 11/2000 | Caicedo | A45F 3/04 | 224/155 |
| 6,186,593 | B1 * | 2/2001 | Garneau | A47C 9/10 | 297/188.11 |
| 7,118,172 | B1 * | 10/2006 | Pattison-Sheets | A47C 4/52 | 224/155 |
| 10,028,587 | B1 * | 7/2018 | Kersey | A47C 4/52 | |
| 2007/0084891 | A1 * | 4/2007 | Gillespie | A47C 7/0213 | 224/155 |
| 2010/0133303 | A1 * | 6/2010 | Schilly | A45F 3/047 | 224/155 |
| 2017/0065062 | A1 * | 3/2017 | Wang | A45F 3/04 | |
| 2020/0315327 | A1 * | 10/2020 | Jones | A45F 4/02 | |
| 2020/0323331 | A1 * | 10/2020 | Marolia | A45F 3/04 | |

* cited by examiner

MULTI-PURPOSE BACKPACK

CROSS REFERENCE TO RELATED APPLICATION

This application claims the benefits of China application Serial No. 202120880672.1, filed Apr. 26, 2021, the disclosures of which are incorporated by references herein in its entirety.

TECHNICAL FIELD

The present disclosure relates in general to a backpack, and more particularly to the multi-purpose backpack that can provide an expandable and retractable supporting structure for resting the user.

BACKGROUND

Nowadays, the pace of people's life is getting faster and faster. It is often seen exhausted people filled on subways or other public transportation system to utilize limited commuting time for supplement sleep. Sometimes, sleepy people might tilt their heads unconsciously to sleep on shoulders of strangers next to them. In addition, in some particular situations such as waiting in a long line or keeping the same posture for a long time while in working or studying, it would be quite possible that the weight of head would gradually fatigue the neck. Under such a circumstance, it would be urgent to find a supportable object to rest. Nevertheless, some elderly, children or handicapped may need a device all the time for helping them to stand, lean on or rest. This disclosure is specifically designed to relieve the aforesaid situations, to resolve these daily problems, and to meet people's special needs.

SUMMARY

This disclosure relates to a multi-purpose backpack that is furnished with a device for providing the user to rest anytime and anywhere. In view of the aforesaid situations, this disclosure provides thereto a series of answers. According to this disclosure, the inherent sleeping style that requires a specific space for lying down would be varied into a new sit-and-sleep style without any space limitation and with least interference to the surroundings. Thereupon, people's requirements for rest anytime and anywhere can be met to the greatest extent.

In order to achieve the foregoing objects, this disclosure provides various technical recipes as follows.

1. From the overall appearance, the backpack (FIG. 1) provided by this disclosure can be carried by hands or by shoulders, and shows no difference with an ordinary backpack.

2. Four different expanding stages of the backpack of this disclosure are listed in FIG. 2 by four sub-figures (2-1 to 2-4). In FIG. 2, a back sheet 1 of the backpack can be opened, and a supporting structure ca be pulled out of the backpack through a handle 2 (FIG. 2-3). The back sheet 1 is a foldable soft seat pad. By pulling down zippers at two lateral sides of the backpack, the soft seat pad can be completely pulled down, can be placed on a seat (FIG. 2-4), or can form a seat by connecting to the supporting structure (FIG. 4-1).

3. By pulling up a handle 2 at a top portion of the backpack, a supporting structure can be pulled vertically up from a main body of the backpack (FIG. 3-1, FIG.-2). The supporting structure is consisted of at least three retractable pivotally posts: a first main supporting retractable post 4, a second main supporting retractable post 3 and a third main supporting retractable post 5. According to environmental conditions of the instant site, extending lengths and expanding angles of the supporting structure can be adjusted to reach the most comfort state.

4. While a foreign seat is available, one post of the supporting structure can be pulled to rest on the seat (FIG. 3-3). On the other hand, to stand the supporting structure, this post can be fully extended to stand on the ground (FIG. 3-4).

5. The supporting structure is firstly pulled vertically up, and then a second half top bracket 6 is pulled frontward to fully extend a top bracket extension rod 7. Thereupon, a rectangular top bracket would be formed on the top of the supporting structure, and a stable triangular supporting structure having three supporting posts 8 to stand on the ground would be formed at a lower portion of the supporting structure (FIG. 3-4).

6. After the supporting structure is stably set, two seat supporting links 9 of the soft seat 1 can be pulled to connect the supporting structure so as to form a suspended seat (FIG. 4-1) able to sustain partial weight of the user.

7. After the soft seat is secured, a retractable neck bracket for fixing and holding the head and neck can be taken out from the backpack. Two elastic neck bracket supporting link 10 can be pulled to connect the neck bracket to the top bracket extension rod 7, so that the neck bracket can be secured. Simultaneously, connecting ropes 11 can be applied in a cross manner to connect the top bracket extension rod 7 and back straps of the backpack, and thus an additional support for resting user head can be provided to increase the user comfort. Thereupon, the multi-purpose backpack that can provide the user to rest anytime and anywhere is thus completely expanded and set.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DETAILED DESCRIPTION

Figure 1:
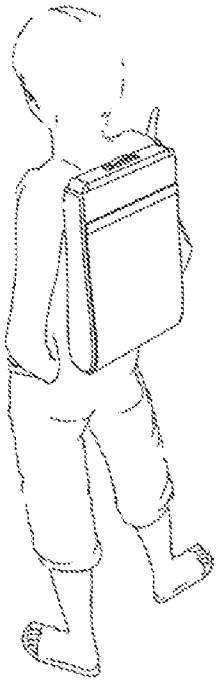
FIG. 1 is a schematic view of a preferred embodiment of the multi-purpose backpack in accordance with this disclosure, disposed at a user back.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In order to achieve the aforesaid purposes, the utility model of this disclosure adopts the following schemes.

Figure 2:
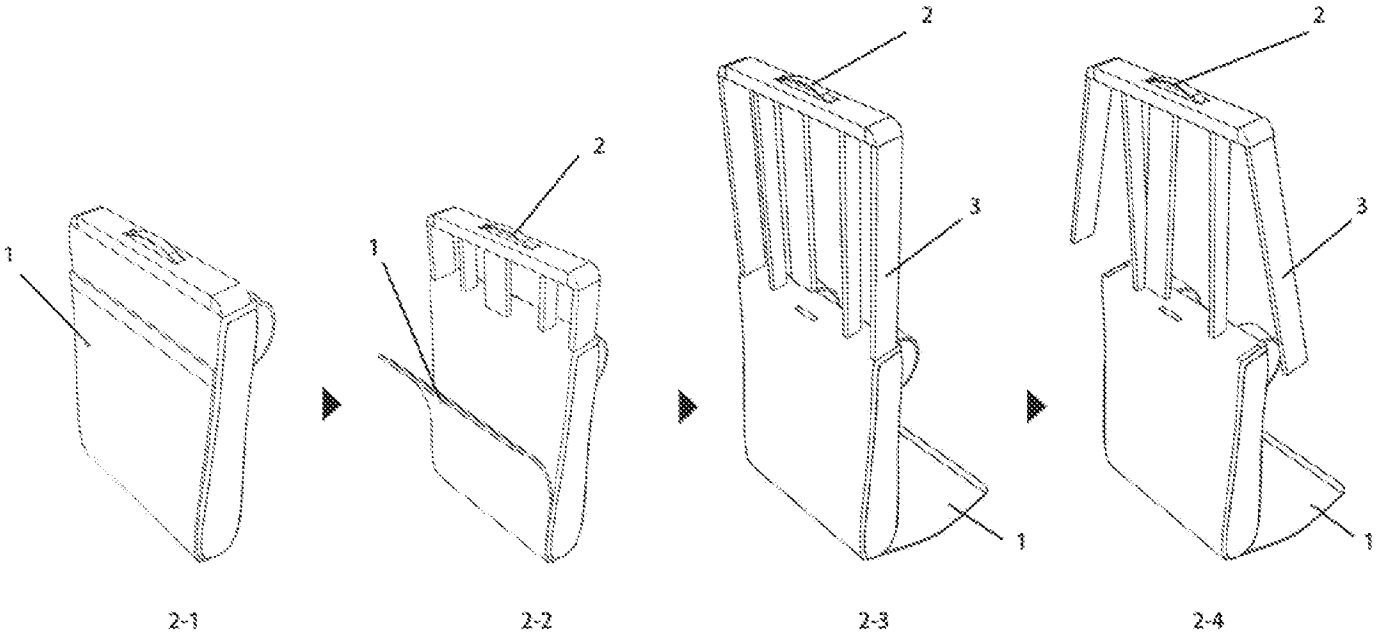
FIG. 2 (including sub-FIGS. 2-1 to 2-4) shows schematically different stages of the multi-purpose backpack of FIG. 1 in turning the soft seat and pulling away the supporting structure.

Viewed from the appearance, the backpack of this disclosure makes no difference to an ordinary backpack. A back sheet 1 of the backpack is designed to be a pad with a soft surface. By pulling down zippers at opposite sides of the backpack, the back sheet 1 can be pulled pivotally to a front side of the backpack, and used as a seat (FIG. 2).

Figure 3:
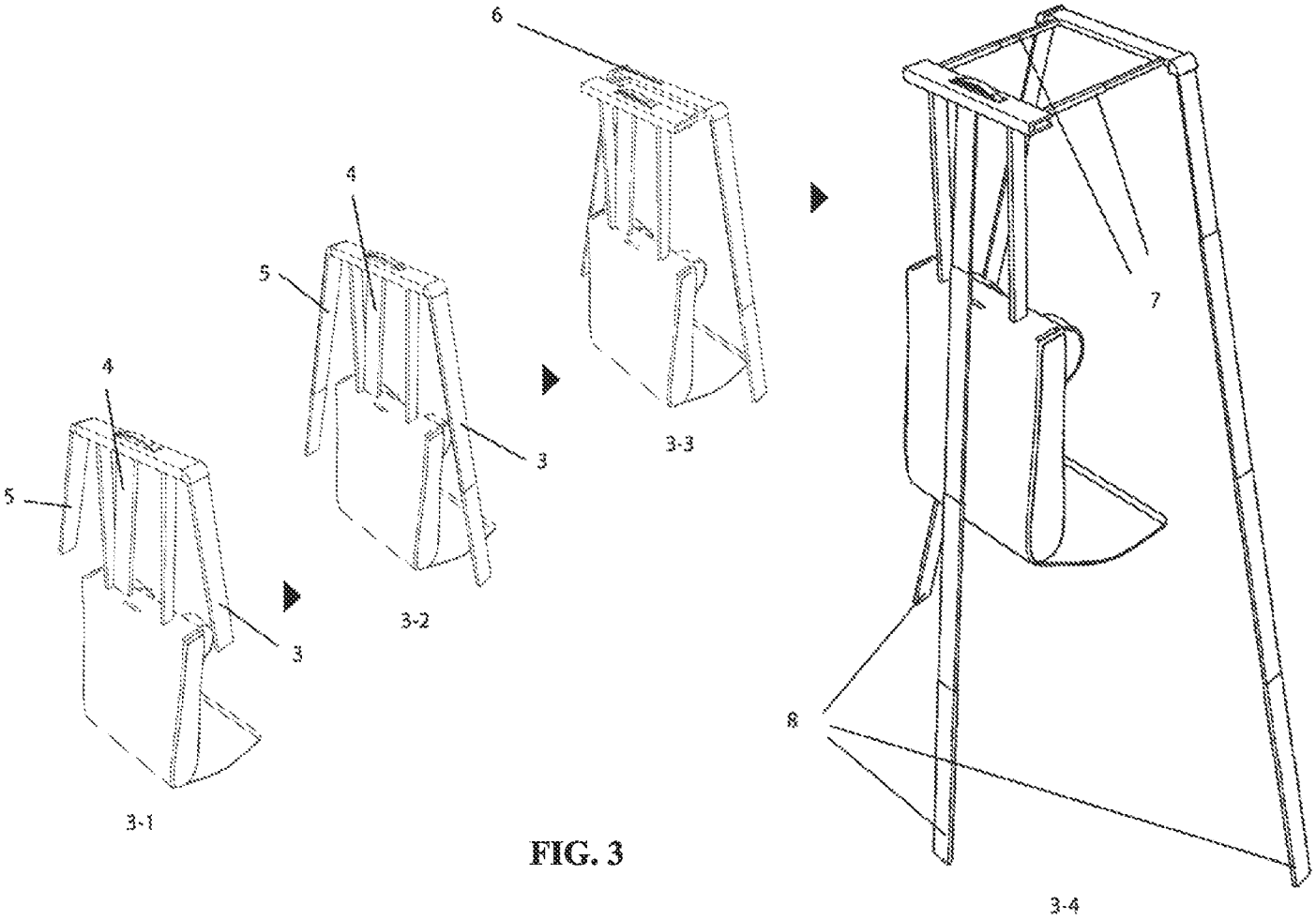
FIG. 3 (including sub-FIGS. 3-1 to 3-4) shows schematically different stages of the multi-purpose backpack of FIG. 1 in expanding completely the supporting structure.
Figure 4:
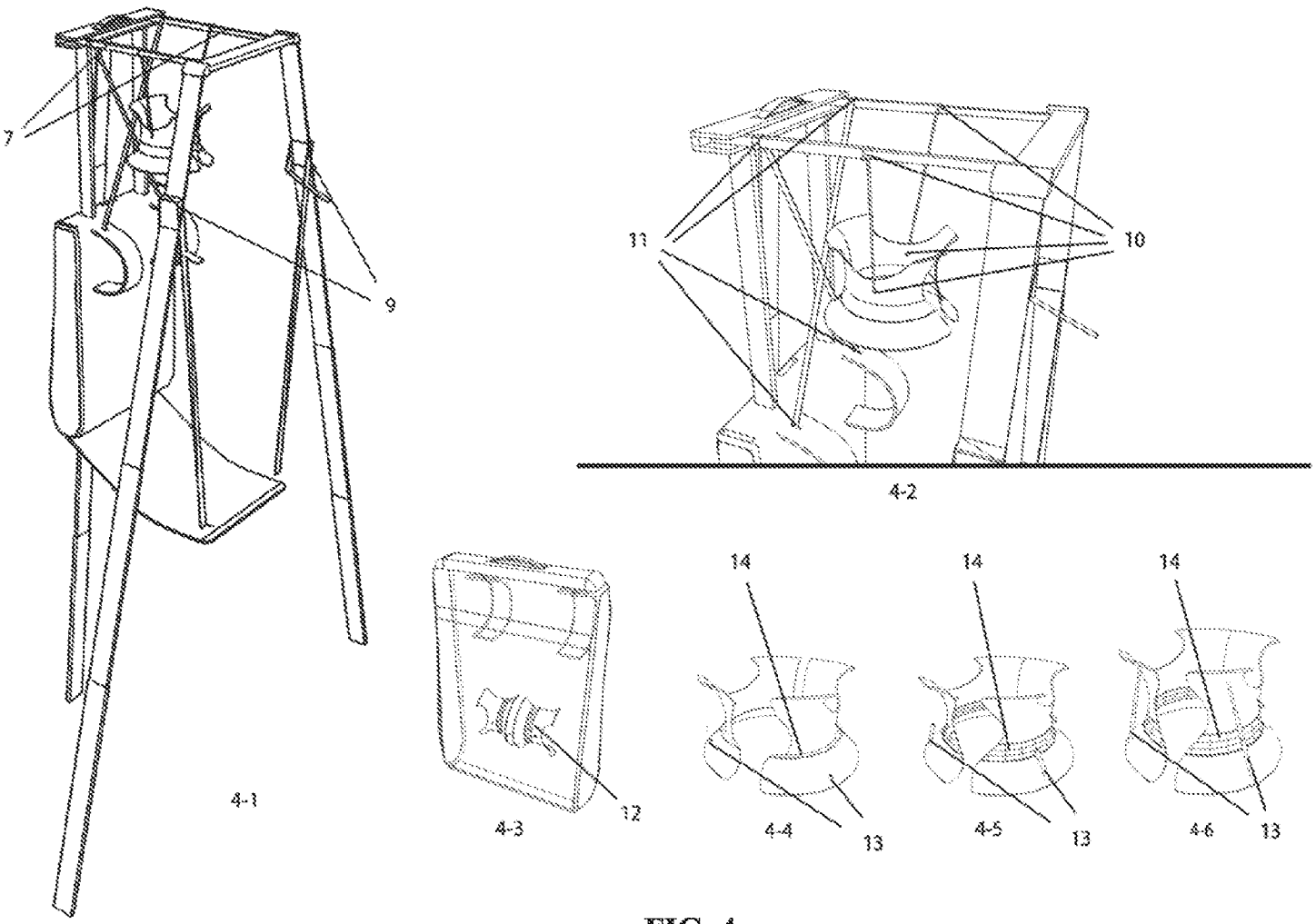
FIG. 4 (including sub-FIGS. 4-1 to 4-6) shows schematically the neck bracket in detail and the mounting of the supporting structures, the seat and the neck bracket in accordance with this disclosure.

By pulling up a handle 2 at a top portion of the backpack, a supporting structure can be pulled vertically up from a main body of the backpack. The supporting structure is consisted of at least three retractable pivotally posts: a first main supporting retractable post 4, a second main supporting retractable post 3 and a third main supporting retractable post 5. The second and third main supporting retractable posts 3, 5 can be expanded pivotally sideward (FIG. 3-4), while the first main supporting retractable post 4 can be expanded pivotally rearward (FIG. 3-4). A second half top bracket 6 of the top bracket can be pulled forward to expose a top bracket extension rod 7 from a first half top bracket of the top bracket. According to environmental conditions of the instant site, extending lengths and expanding angles of the supporting posts 8 can be adjusted to meet the most comfort state. In FIG. 3, sub-FIGS. 3-1, 3-2, 3-3 and 3-4 demonstrate different stages of the supporting posts 8 after being pulled from the main body. In a final stage shown in sub-FIG. 3-4, the supporting posts 8 are expanded and turned into a stable triangular supporting structure having a top rectangular bracket and three legs able to stand on a ground (FIG. 3-4).

After the triangular supporting structure is set on the ground, two seat supporting links 9 of the soft seat 1 are pulled to connect the second and third main supporting retractable posts 3, 5 (FIG. 4-1), so as to secure the seat to the triangular supporting structure. Thereupon, the seat is now ready for carrying a user.

Figure 5:
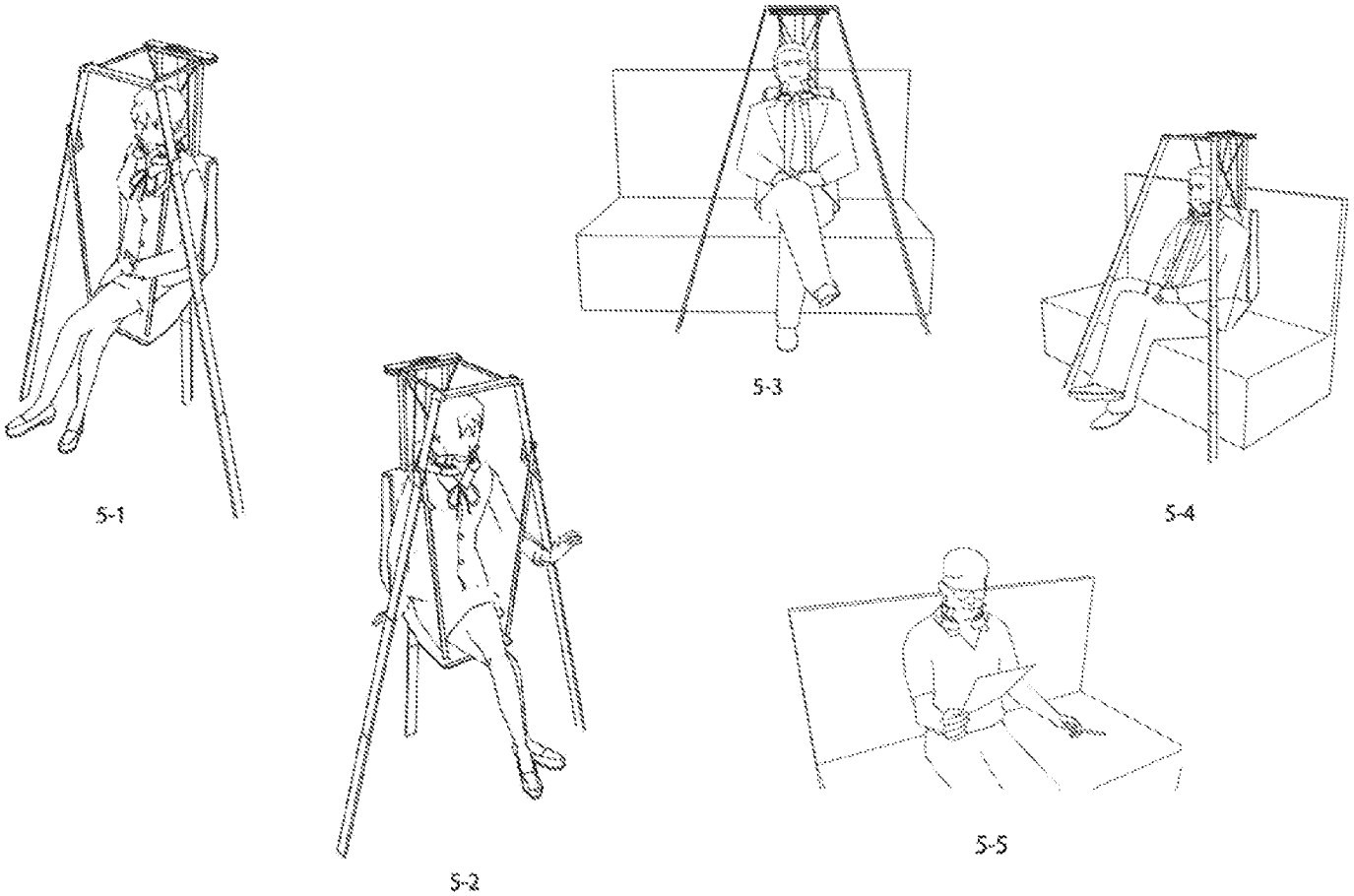
FIG. 5 (including sub-FIGS. 5-1 to 5-5) shows schematically different practical applications of the multi-purpose backpack of FIG. 1.

A neck bracket 12 is normally stored inside the main body of the backpack (FIG. 4-3). While in use, at least one neck bracket supporting link 10 is pulled to connect the top bracket extension rod 7 of the top bracket (FIG. 4-2), such that the neck bracket 12 can be secured. According to different needs, the neck bracket supporting link 10 of the neck bracket 12 can be left around a user neck, and not to connect the top bracket extension rod 7. In this embodiment, the neck bracket 12 has an adjustable height. A middle expandable section 14 of the neck bracket 12 can be folded and expanded to meet different user needs (FIG. 4-4, DIF. 4-5). Two opposite adjustable neck supporting rods 13 are provided externally to opposite sides of the neck bracket 12. With the neck supporting rods 13 to provide better support upon user's lower jaw, the neck bracket 12 can reduce swinging of user head, and thus use comfort can be promoted (FIG. 4-4, FIG. 4-5, FIG. 4-6). Simultaneously, connecting ropes 11 can be applied in a cross manner to connect the top bracket extension rod 7 and back straps of the backpack, and thus an additional support for resting user head can be provided to increase the user comfort (FIG. 4-2).

After the supporting posts, the seat and the neck bracket are settled, FIG. 5 demonstrates various applications of this disclosure. First, in a situation having no seat available, the three supporting posts can be retracted and expanded completely to form a stable triangular structure, then the user can sit on the seat with the neck bracket on and adjusted to an appropriate neck height, and thus the user can relax to rest on the seat (FIG. 5-1 and FIG. 5-2). In another situation having the chair, the second and third main supporting retractable posts can be completely expanded, the first main supporting retractable post can be pulled to touch the chair, and the soft seat can be directly turned to place on the chair without any connection to the supporting posts, such that the user can rest on the chair with the neck bracket on and adjusted to an appropriate neck height (FIG. 5-3, FIG. 5-4). Of course, the neck bracket of this disclosure can be used independently. In any situation of neck discomfort, the neck bracket can be solely used to relax the head and the neck of the user.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A backpack, comprising:
- a main body; and
- a supporting structure, comprising:
  - a top bracket;
  - a vertical bracket supporting post connecting said top bracket and said main body;
  - a first main supporting retractable post connecting to said top bracket;
  - a second main supporting retractable post connecting to said top bracket; and
  - a third main supporting retractable post connecting to said top bracket;
- wherein said top bracket is configured to be pulled away from said main body, and then said first main supporting retractable post, said second main supporting retractable post, and said third main supporting retractable post are expanded; and
- wherein said first main supporting retractable post, said second main supporting retractable post, and said third main supporting retractable post are stored in said main body before pulling away said top bracket from said main body.

2. The backpack as claimed in claim 1, further comprising:
- a seat attached to said main body; and
- a seat supporting link connecting said seat to said second main supporting retractable post.

3. The backpack as claimed in claim 2, wherein said seat is in a secured position on said main body with a zipper.

4. The backpack as claimed in claim 1, wherein said top bracket further comprises:
- a first half top bracket, wherein said vertical bracket support post and said first main supporting retractable post are connecting to said first half top bracket;

a second half top bracket, wherein said second main supporting retractable post and said third main supporting retractable post are connecting to said second half top bracket; and a top bracket extension rod connecting to said first half top bracket and said second half top bracket, wherein said top bracket extension support extends and separates said first half top bracket and said second half top bracket as said backpack turns into said seat.

5. The backpack as claimed in claim 4, further comprising:

a shoulder strip attached to said main body; and a shoulder strip supporting link connecting said shoulder strip to said top bracket extension rod.

6. The backpack as claimed in claim 4, further comprising:

a neck bracket comprising a bottom section, a middle expandable section, and a top section, wherein said neck bracket raises by expanding said middle expandable section;

a neck bracket supporting link connecting said neck bracket to said top bracket extension; and a neck supporting rod, wherein said neck supporting rod attaches to said bottom section and said middle expandable section for supporting said neck bracket to expand.

7. The backpack as claimed in claim 1, further comprising:

a neck bracket comprising a bottom section, a middle expandable section, and a top section, wherein said neck bracket raises by expanding said middle expandable section; and a neck supporting rod, wherein said neck supporting rod attaches to said bottom section and said middle expandable section for supporting said neck bracket to expand.

8. The backpack as claimed in claim 7, wherein said neck bracket further comprises a left half and a right half.

* * * * *